US006174242B1

(12) United States Patent
Briggs et al.

(10) Patent No.: US 6,174,242 B1
(45) **Date of Patent: *Jan. 16, 2001**

(54) SELF-CONTAINED INTERACTIVE PLAY STRUCTURE

(75) Inventors: Rick A. Briggs, Springfield, IL (US); Mark Weston; Denise Weston, both of North Attleboro, MA (US); Brendan Cuddihee, Eureka, MO (US)

(73) Assignee: Koala Corporation, Denver, CO (US)

( * ) Notice: Under 35 U.S.C. 154(b), the term of this patent shall be extended for 0 days.

This patent is subject to a terminal disclaimer.

(21) Appl. No.: 09/277,232

(22) Filed: Mar. 26, 1999

Related U.S. Application Data

(60) Provisional application No. 60/079,581, filed on Mar. 26, 1998.

(51) Int. Cl.[7] ..... A63G 31/00

(52) U.S. Cl. ..... 472/136; 472/116

(58) Field of Search ..... 472/128, 136, 472/137, 116; 482/35, 36, 37; 273/357, 406

(56) References Cited

U.S. PATENT DOCUMENTS

| | | | | |
|---|---|---|---|---|
| D. 403,392 | | 12/1998 | Briggs et al. . | |
| D. 406,871 | | 3/1999 | Briggs . | |
| D. 407,133 | | 3/1999 | Briggs . | |
| 3,802,705 | * | 4/1974 | Burns et al. | 273/357 |
| 4,186,927 | * | 2/1980 | Breslow et al. | 273/357 |
| 5,194,048 | | 3/1993 | Briggs . | |
| 5,226,864 | | 7/1993 | Showers . | |
| 5,251,906 | * | 10/1993 | Heller et al. | 273/357 X |
| 5,405,294 | | 4/1995 | Briggs . | |
| 5,554,074 | | 9/1996 | Von Parrish . | |
| 5,662,525 | | 9/1997 | Briggs . | |
| 5,673,918 | | 10/1997 | Bigari . | |
| 5,820,471 | | 10/1998 | Briggs . | |
| 5,853,332 | | 12/1998 | Briggs . | |
| 5,865,680 | | 2/1999 | Briggs . | |

FOREIGN PATENT DOCUMENTS

WO 97/06867 2/1997 (WO) .

OTHER PUBLICATIONS

SCS Interactive Family Adventures Discovery Treehouse brochure "Our Innovations Are In Play Around the World-"–Soft Play sheet (1994).
The Pentes Playbill, Show Edition, 1995.
The Pentes Playbill, Show Edition 1996.
SCS Interactive—Interactive Water Fun $H_2$ouse brochure (1997).
SCS Interactive—Interactive Waterplay Arena brochure (1997).
SCS Interactive—Caribbean Family Adventure brochure.
Interactive WaterPlay Systems brochure (1995).
Innovative Foam Technology—Introduction sheet to "Soft, Lightweight Participatory Play Equipment" (1991).

* cited by examiner

*Primary Examiner*—Kien T. Nguyen
(74) *Attorney, Agent, or Firm*—Knobbe, Martens, Olson & Bear, LLP

(57) ABSTRACT

A self-contained interactive play structure is provided having an outer housing and a plurality of towers disposed within the housing. A plurality of play media including impact-safe projectile accelerators are disposed throughout the structure. A central targeting area is provided having targets which, when contacted by a projectile, activate desired play effects. A projectile conveyor system supplies projectiles to be shot from the projectile accelerators.

54 Claims, 11 Drawing Sheets

SELF-CONTAINED INTERACTIVE PLAY STRUCTURE

This application claims benefit to provisional application Ser. No. 60/079,581, filed Mar. 26, 1998.

BACKGROUND OF THE INVENTION

1. Field of the Invention

The present invention relates generally to the field of children's play structures and, in particular, to self-contained interactive play structures for safely entertaining and educating young and intermediate age children and adults.

2. Description of the Related Art

Over the past decade there has been a steady proliferation of commercial play structures designed to meet the recreational needs of young families. Such play structures can provide a safe and exciting alternative to more traditional parks and playgrounds. Participatory or interactive play structures, that is, play structures that allow play participants to actively participate in creating desired effects, are particularly desirable because of their widely recognized entertainment and educational benefits. See, for example, my U.S. Pat. No. 5,194,048 and related design patent D330,579. These patents first disclosed the concept of interactive or participatory play in the context of a water park attraction.

Many large-scale successful commercial water parks now incorporate interactive play structures of the type disclosed in my U.S. Pat. No. 5,194,048. Families that have patronized these commercial water parks have discovered for themselves the valuable entertainment and educational benefits that interactive play provides. Sales of admission tickets for many such commercial water parks have surged following the introduction of new play structures for facilitating interactive play.

Commercial play structures may be adopted either for water use ("wet" play structures) or non-water use ("dry" play structures), as desired. The subject invention relates particularly to dry interactive play structures for either indoor or outdoor use. A typical dry play structure may include a padded framework and cushioned floors defining a variety of play elements or areas. Slides, tunnels, net bridges, and ladders may be used to interconnect the various play elements and play areas together so that play participants can traverse from one play element or area to the next.

On the other hand, there are certain unique aspects and desirable play dynamics of wet play structures which, heretofore, have not been satisfactorily met by their dry counterparts. For example, an especially exciting and entertaining play activity supported by a wet play structure involves shooting a stream of water at selected targets and/or other play participants. This usually entails some form of a water cannon, water gun, squirt gun, spray hose or the like, which play participants can operate to surprise other play participants or to achieve desired effects. Such participatory play activities provide particular benefits in developing children's motor skills and hand-eye coordination. It also provides endless fun for play participants, who enjoy the challenge of trying to hit various targets and/or one another.

Water as a primary play media lends itself readily to facilitating such play activities because it is easily extruded through a nozzle or otherwise formed into various projecting streams or other entertaining shapes and/or patterns. Also, water can be collected and recirculated to the various play elements using pumps or other efficient and commercially available recirculating and transporting means.

However, unlike a stream of water, which is able to assume a relatively streamlined aerodynamic shape during flight and which disperses harmlessly on impact, dry play media typically involves the use of discrete articles having a defined size, shape and mass which remain constant during flight and upon impact. Moreover, while water is easily regulated at the source to ensure that the pressure and impact velocity of the resulting stream remains within predetermined safe parameters, the impact velocity of discrete projectiles is not so easily regulated. Thus, while it is possible to project an impact-safe stream of water over relatively large distances of 20 to 30 feet with fairly good accuracy, the same task becomes considerably more difficult when using discrete projectiles such as foam or plastic balls.

Dry play structures face additional concerns that are not raised by wet play structures. For instance, the prior art does not satisfactorily address the problem of how to collect and recirculate a non-fluid play media so as to support play activities in a dry play structure. Also, errant or stray water streams or sprays do not present a significant problem in wet play structures. If the errant water cannot be recirculated, the water will soak into the ground or evaporate. Also, replenishing or adding water to a wet play system is relatively easy and inexpensive. Such is not the case, however, with dry play structures. Errant projectiles will not simply evaporate or soak into the ground. Instead, they may become permanently lost or may clutter up areas of the apparatus. Also, if projectiles are hidden or otherwise lost, the supply of projectiles must be replenished. This may involve significant expense, time delay, and administrative headache.

Yet another unique consideration associated with dry play structures is that, in contrast to water, dry play media such as foam or plastic projectiles may age or degrade over time, especially when exposed to environmental elements. Thus, the properties of the projectiles may change over time and the projectiles may lose some of their important performance and safety characteristics.

Commercial parks often desire attractions that are independent and stand by themselves. Part of what makes a play attraction commercially successful is the ability of the park to monitor play participants' entry, exit and overall use of the facility. Also, a play attraction or structure is most advantageous if it can be easily adapted to comply with a theme such as popular animated characters or children's stories, thus becoming more pleasing to play participants.

To facilitate interactive play between participants, the shape of the attraction is preferably such that play participants can see and interact with each other. However, conventional buildings generally have areas that are secluded and non-interactive with the rest of the facility.

SUMMARY OF THE INVENTION

An object of the present invention, therefore, is to provide a self-contained play attraction comprising a play structure and play structure housing to provide shooting and targeting play dynamics and interactive play capabilities using impact-safe dry foam projectiles (or other impact-safe projectiles). Another object of the present invention is to provide a play arena with a pleasing shape that also facilitates interaction between play participants scattered about the entire arena. Another object of the present invention is to provide various safe and durable devices for launching or propelling dry play media at various targets and/or other play participants. Another object of the present invention is to provide means for protecting such dry play media from the environment. Another object of the present invention is to provide an impact-safe play media particularly adapted for use in a dry play structure for shooting and targeting play dynamics and interactive play capabilities. Another object of the present invention is to provide effective containment of dry play media such as projectiles. Another object of the present invention is to provide various automated and/or play participant operated conveyers for collecting, recirculating and/or transporting dry play media to various play areas or interactive play elements disposed throughout a play structure. Another object of the present invention is to facilitate various interactive play activities which incorporate a wide range of fun and exciting mechanisms, such as springs, cams, pulleys, gears, and the like, all of which can be employed to provide an interactive play experience which is both fun and, at the same time, educational.

In one embodiment the present invention provides an interactive play structure in which various dry play media, such as foam balls or other play articles, can be propelled, accelerated or otherwise transported from one location to another in the play structure in response to various play-participant controlled actuators.

In another embodiment the present invention provides a dry interactive play structure for facilitating interaction between play participants who are located remotely from each other. For example, a propelling device may be mounted at a first location on the play structure, dry play media for the device may be supplied at an inlet at a second location on the structure and an actuator for the device may be located at yet a third location on or adjacent to the play structure. Play media obtained from the second location can be fed to the device at the first location, and a play participant at the third location can activate the device to launch play media at a target or other unsuspecting play participants.

In another embodiment the present invention provides an interactive conveyor system which can be operated by one or more play participants to transport dry play media from one location on the play structure to another location. The first location may be a discharge collection area of one or more interactive play elements or devices, and the second location may be a supply area for the same or other play elements. Dry play media may be recycled for reuse in the various devices using the efforts of play participants.

In another embodiment the present invention provides an automated dry play media conveyor, which may be used to transport dry play media from one location on the play structure to another. The first location may be a discharge collection area of one or more interactive play elements, and the second location may be one or more supply areas for the same or other play elements. The play media conveyor system may be operated by a small electrical motor or may be manually operated by a crank or other such devices. Dry play media may therefore be efficiently recycled for reuse in the various interactive devices automatically, via play participant interaction.

In another embodiment of the present invention, a projectile play arena is provided for entertaining one or more play participants. The play arena contains a central target tower which is adapted to actuate special play effects strategically placed among the play participants. The play participants activate the special play effects through the use of various devices, such as a variety of pump guns, sling shots, cross-bows, pneumatic projectile launchers and the like. For example, a play participant may shoot projectiles from a pneumatic ball launcher such that a target is struck. Once the target is struck, a controlled valve opens and allows a stream of balls to spew forth creating a desired effect. By providing targets of various levels of difficulty, play participants of all ages are able to engage in play at the same time and in the same arena. The central target area also creates an environment in which all play participants may interact through either cooperation or competition. Thus, the present invention involves all play participants in interactive play through the use of the common central target region and the creation of desired play effects as "rewards" for successfully activating various targets or objects.

In another embodiment the present invention provides an outdoor play structure housing for facilitating interactive dry play in an outdoor theme park or other facility. The housing may be themed in accordance with a variety of children's adventures or stories, as desired.

In another embodiment the present invention provides a free-standing self-contained play apparatus with a housing having walls and a roof structure. Play towers within the housing support play participants playing thereon. The towers are arranged around a central target area having a number of targets. The targets, when contacted, create desired effects.

In another embodiment the present invention provides a method for providing a themed self-contained interactive play attraction for entertaining play participants. The method includes providing a free-standing housing including multiple sides and a roof; providing play towers within the housing; providing impact-safe projectile launchers on the towers; and providing targets.

For purposes of summarizing the invention and the advantages achieved over the prior art, certain objects and advantages of the invention have been described hereinabove. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

All of these embodiments are intended to be within the scope of the invention herein disclosed. These and other embodiments of the present invention will become readily apparent to those skilled in the art from the following detailed description of the preferred embodiments having reference to the attached figures, the invention not being limited to any particular preferred embodiment(s) disclosed.

DETAILED DESCRIPTION OF THE PREFERRED EMBODIMENTS

Figure 1:
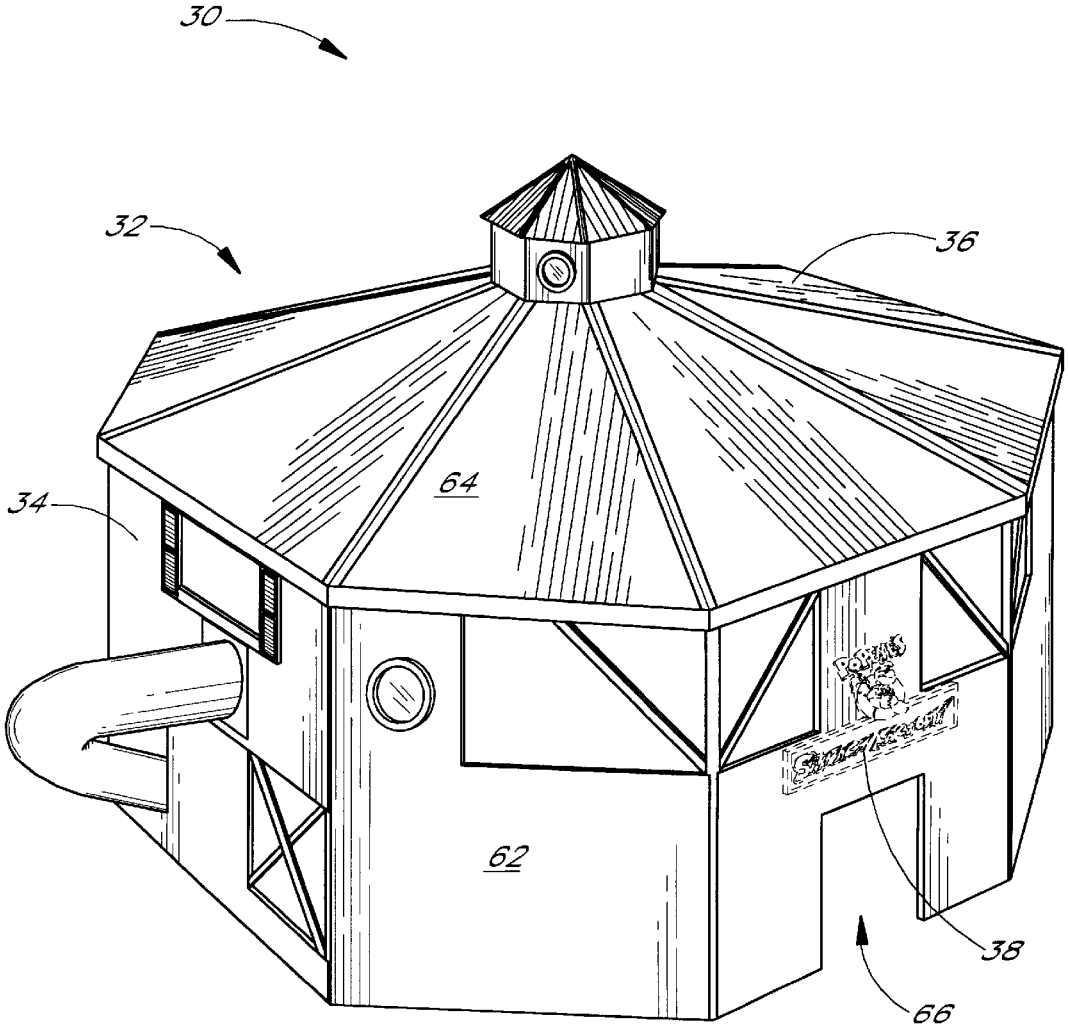
FIG. 1 is a perspective view of a play structure housing having features and advantages in accordance with the present invention.
Figure 3:
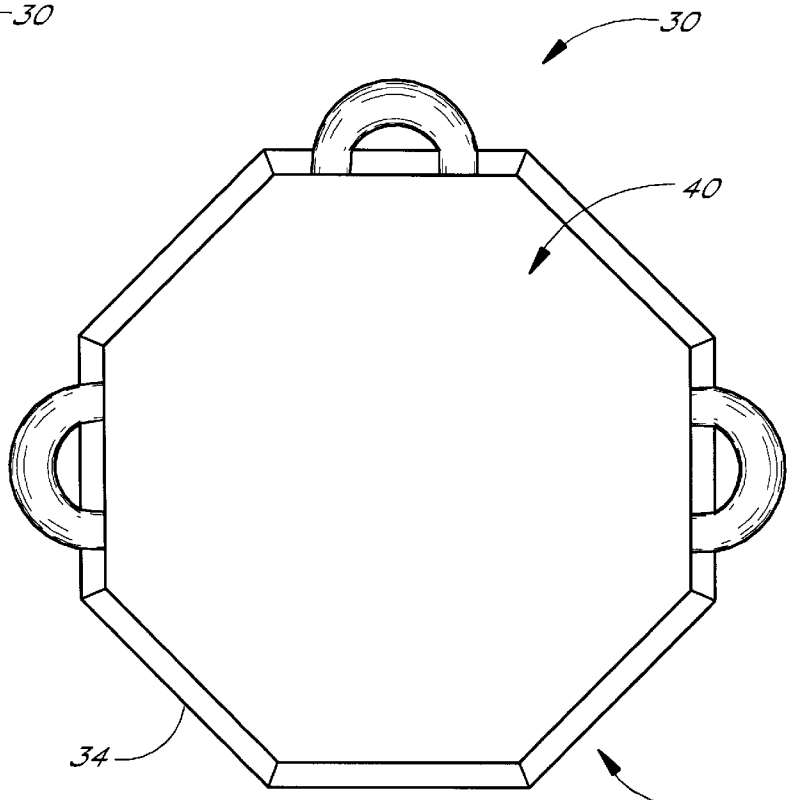
FIG. 3 is a top view showing the wall layout of the play structure housing of FIG. 1.
Figure 2:
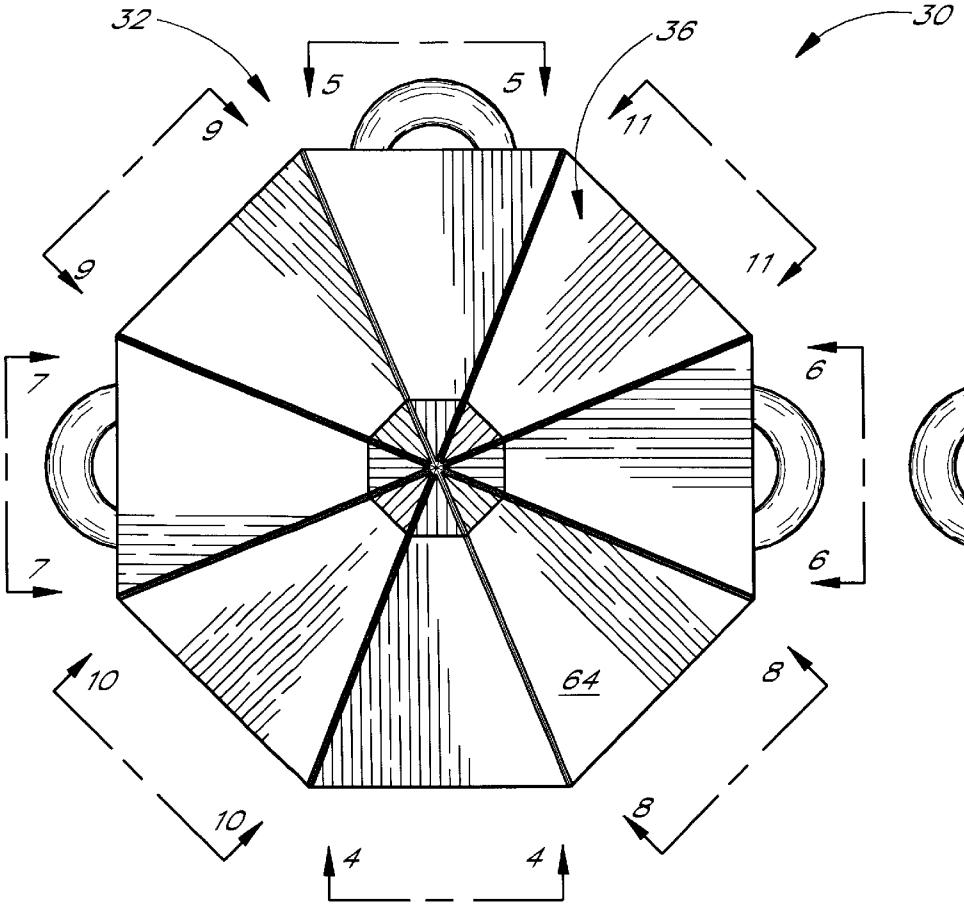
FIG. 2 is a top view of the play structure housing of FIG. 1.
Figure 4:
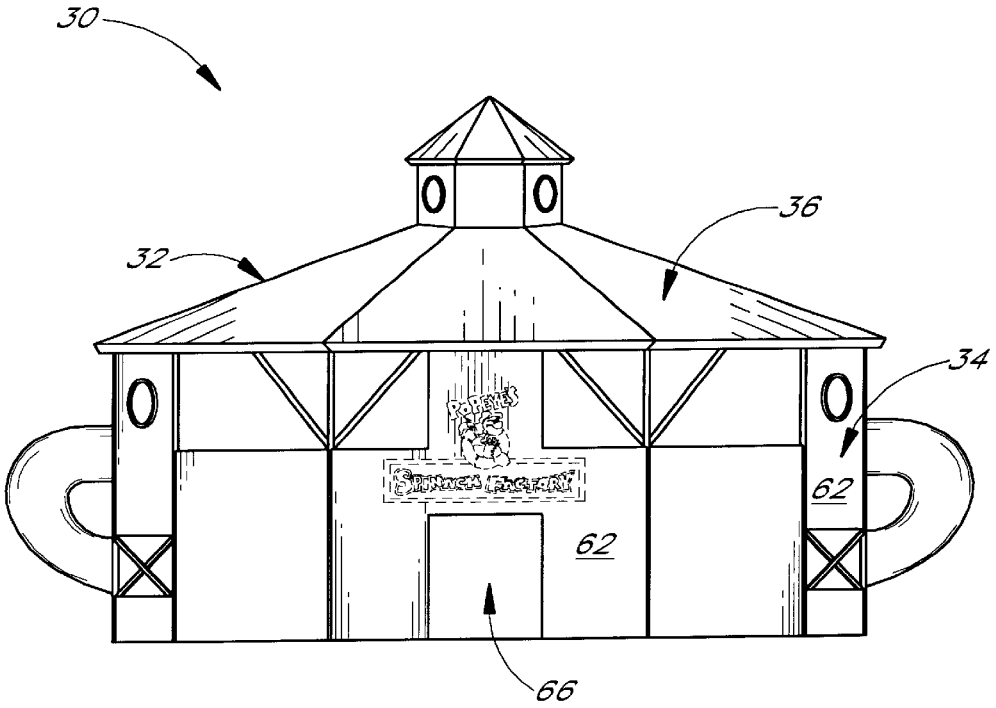
FIG. 4 is a side view of the play structure housing of FIG. 2 taken along lines 4—4.
Figure 5:
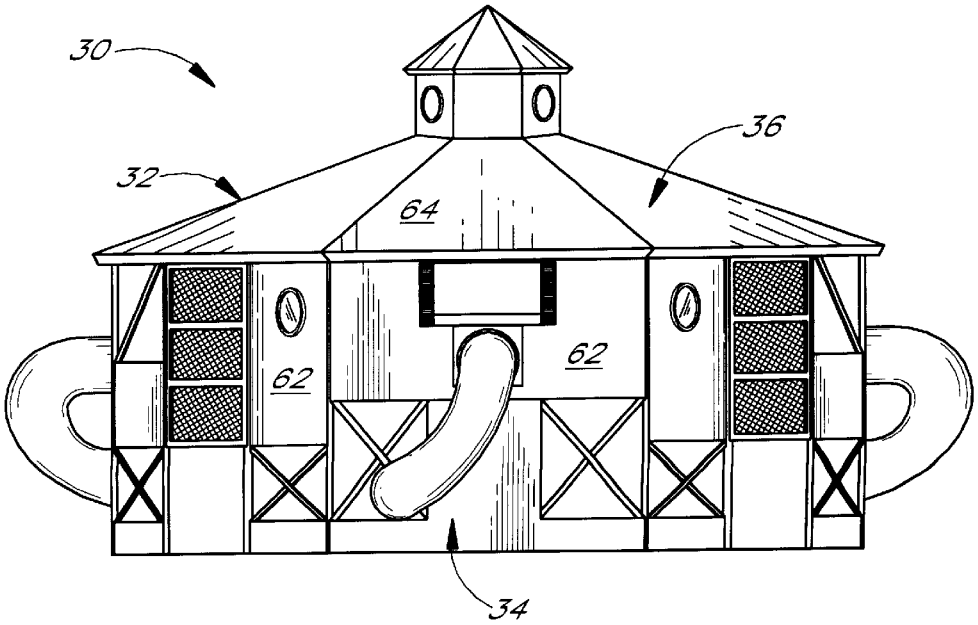
FIG. 5 is a side view of the play structure housing of FIG. 2 taken along lines 5—5.
Figure 6:
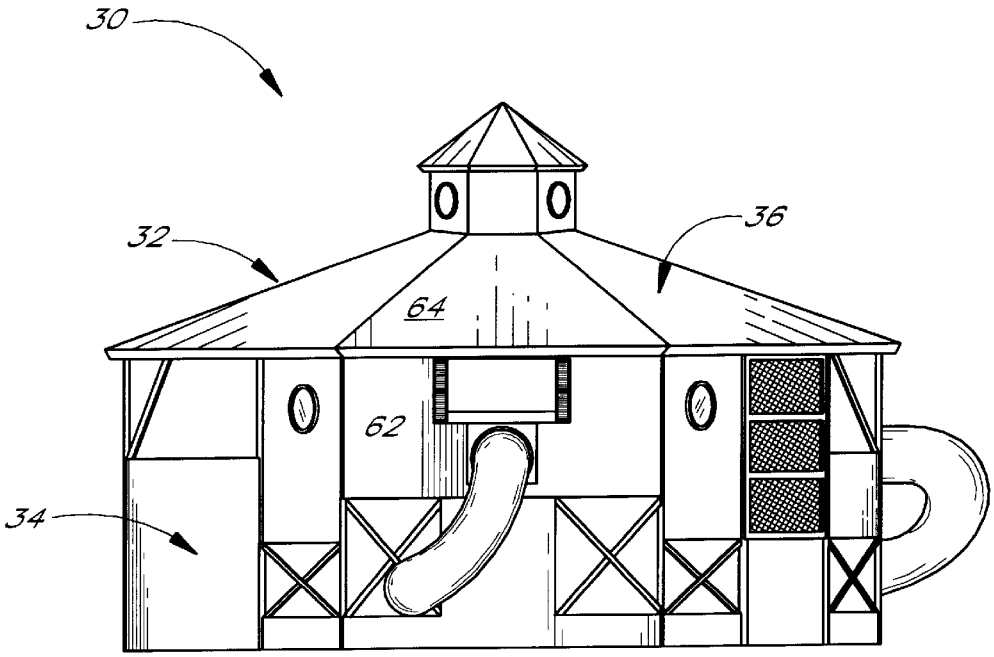
FIG. 6 is a side view of the play structure housing of FIG. 2 taken along lines 6—6.
Figure 7:
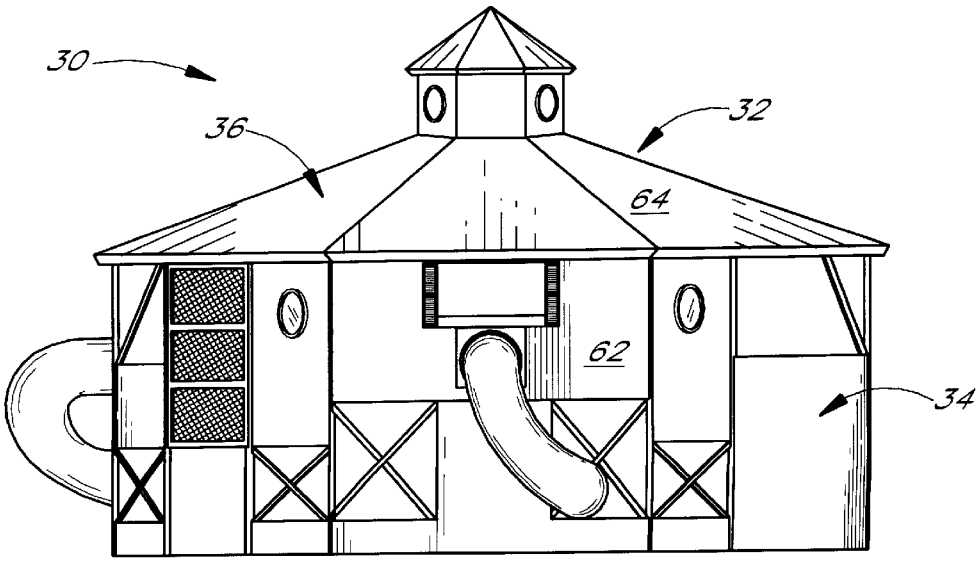
FIG. 7 is a side view of the play structure housing of FIG. 2 taken along lines 7—7.
Figure 8:
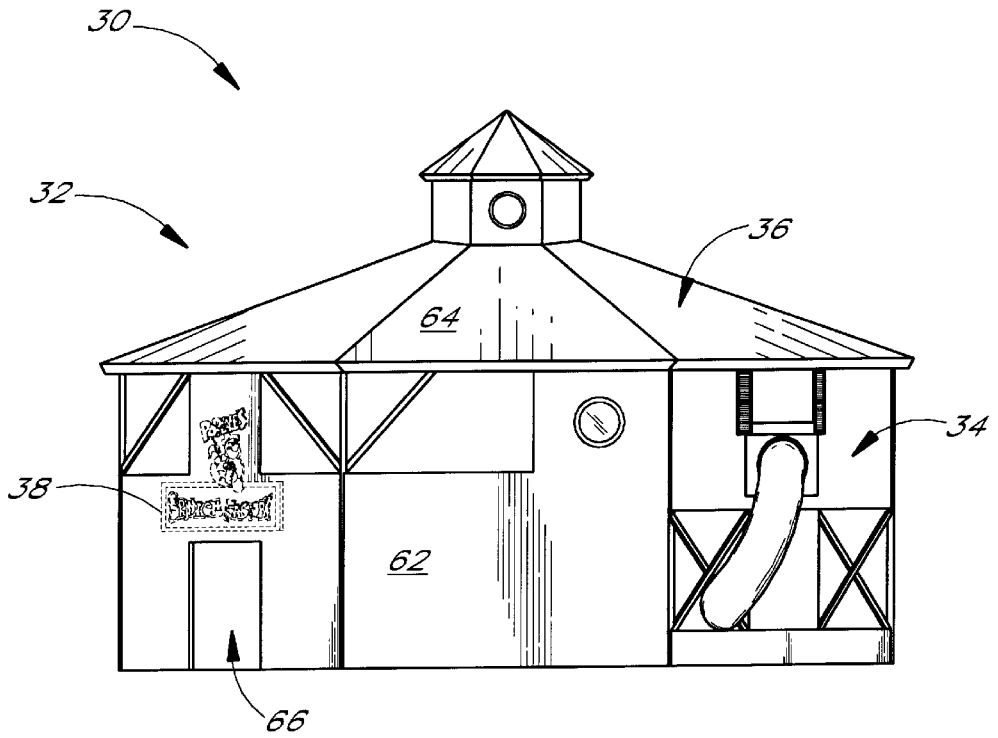
FIG. 8 is a side view of the play structure housing of FIG. 1 taking along lines 8—8.
Figure 9:
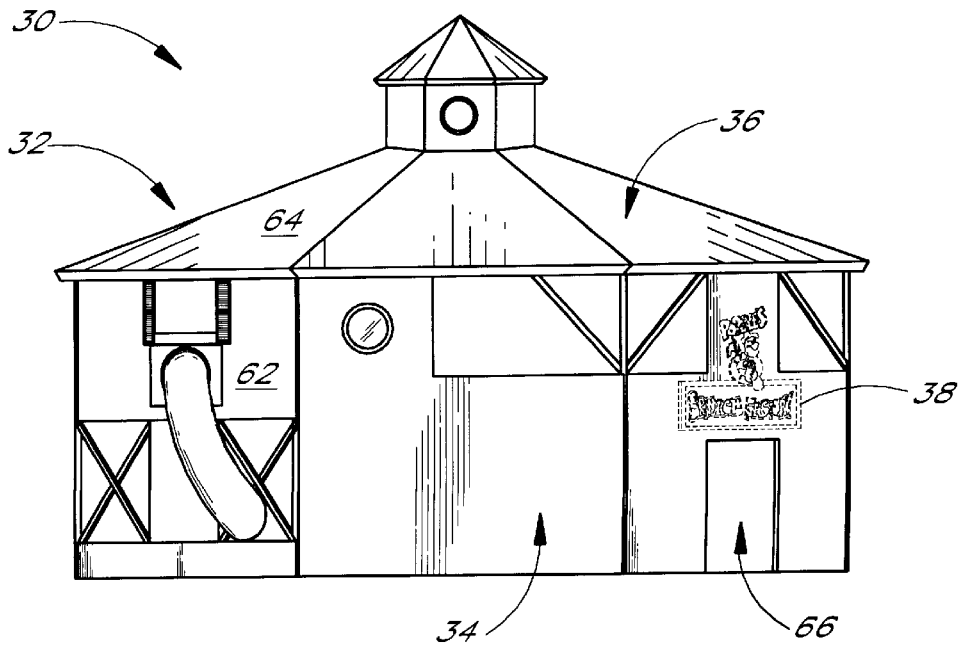
FIG. 9 is a side view of the play structure housing of FIG. 2 taken along lines 9—9.
Figure 10:
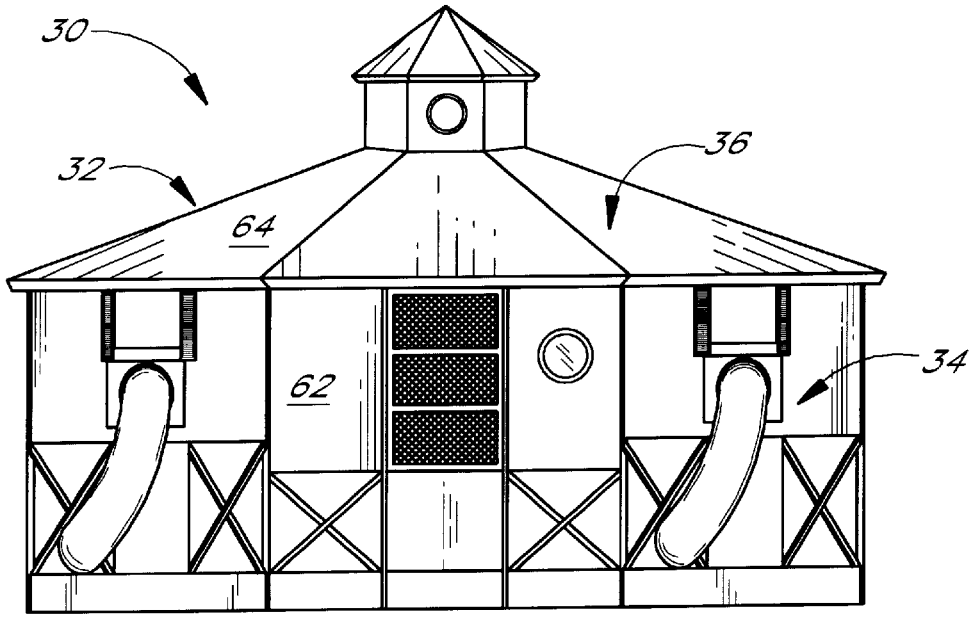
FIG. 10 is a side view of the play structure housing of FIG. 2 taken along lines 10—10.
Figure 11:
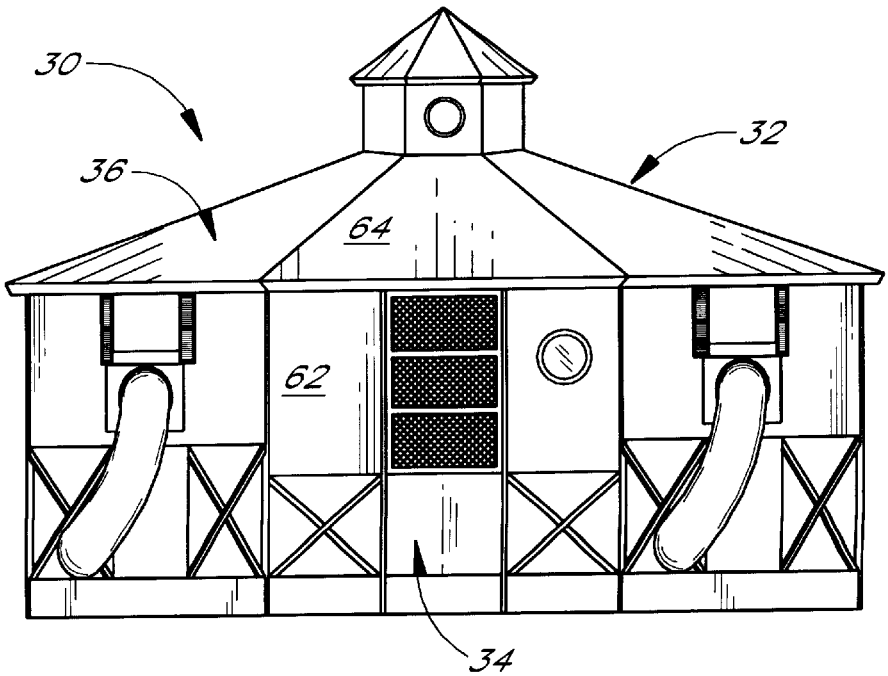
FIG. 11 is a side view of the play structure housing of FIG. 2 taken along lines 11—11.

With first reference to FIG. 1, a preferred embodiment of a free-standing self-contained play attraction 30 having features and advantages in accordance with the present invention has a housing 32 with walls 34 and a roof structure 36. The particular play structure 30 shown is provided in the theme of a "Popeye's Spinach Factory." Graphics 38 consistent with the theme are disposed on the housing walls 34 and throughout the structure 30. With next reference to FIGS. 2 and 3, the housing 32 preferably is octagonal in shape and defines a fully-enclosed play arena 40. FIGS. 4–11 show various other views of the apparatus 30 of FIG. 1.

Those skilled in the art will readily appreciate that the present invention may be implemented in accordance with a wide variety of possible embodiments and exciting play themes using any combination of familiar and fun play media. For example, a medieval castle, lost temple, military fort or fire station can each provide an exciting play theme for an interactive play structure having features and advantages as taught herein. Dry play media may include a wide diversity of items such as, for example, tennis balls, plastic or rubber balls, beach balls, balloon balls, styrofoam particles, frisbees, hula-hoops, foam balls/darts/arrows, as well as a variety of other fun and exciting play media well known to those skilled in the art.

Figure 12:
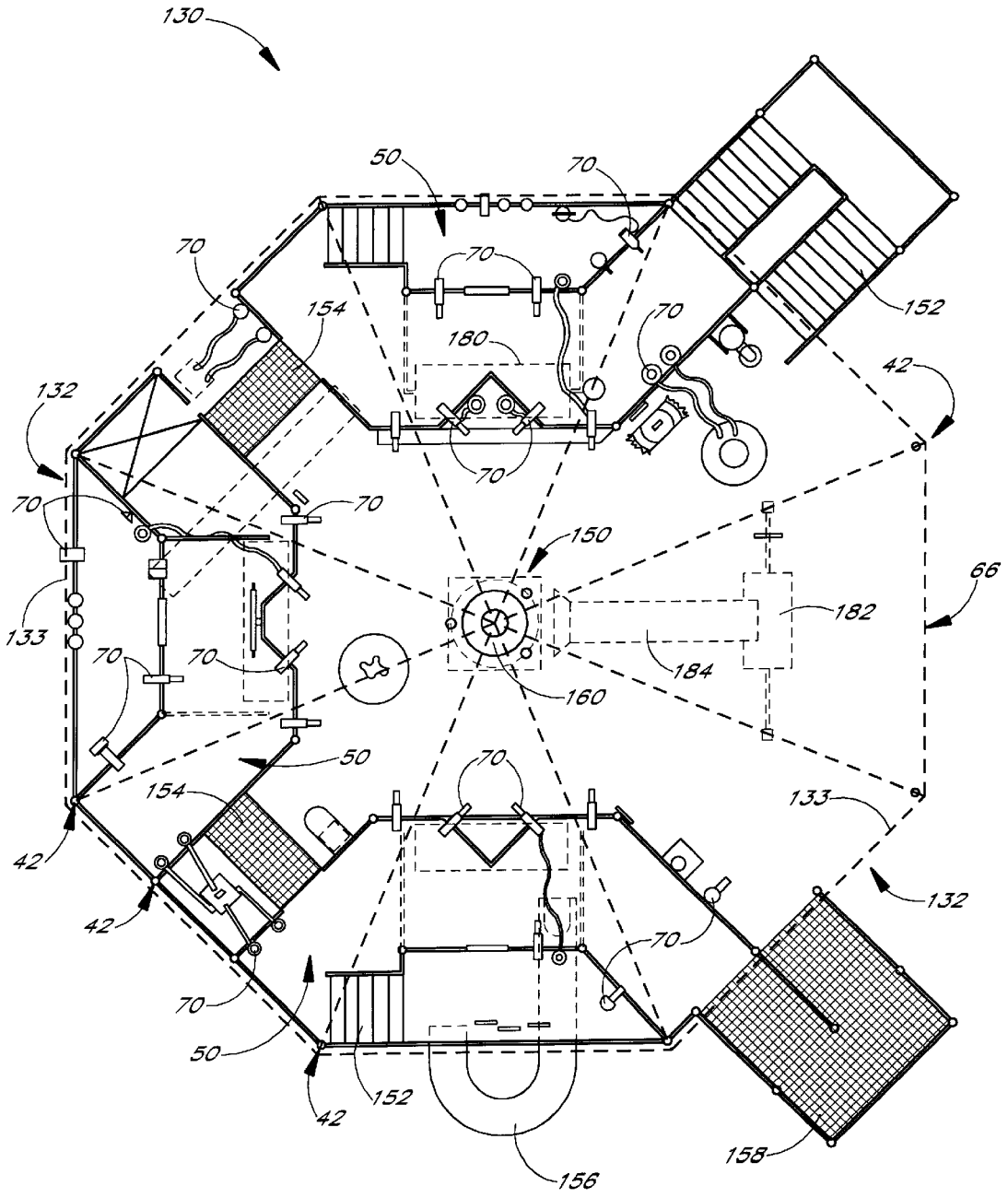
FIG. 12 is a schematic floor plan of an embodiment of play structure and housing having features of the present invention.
Figure 13:
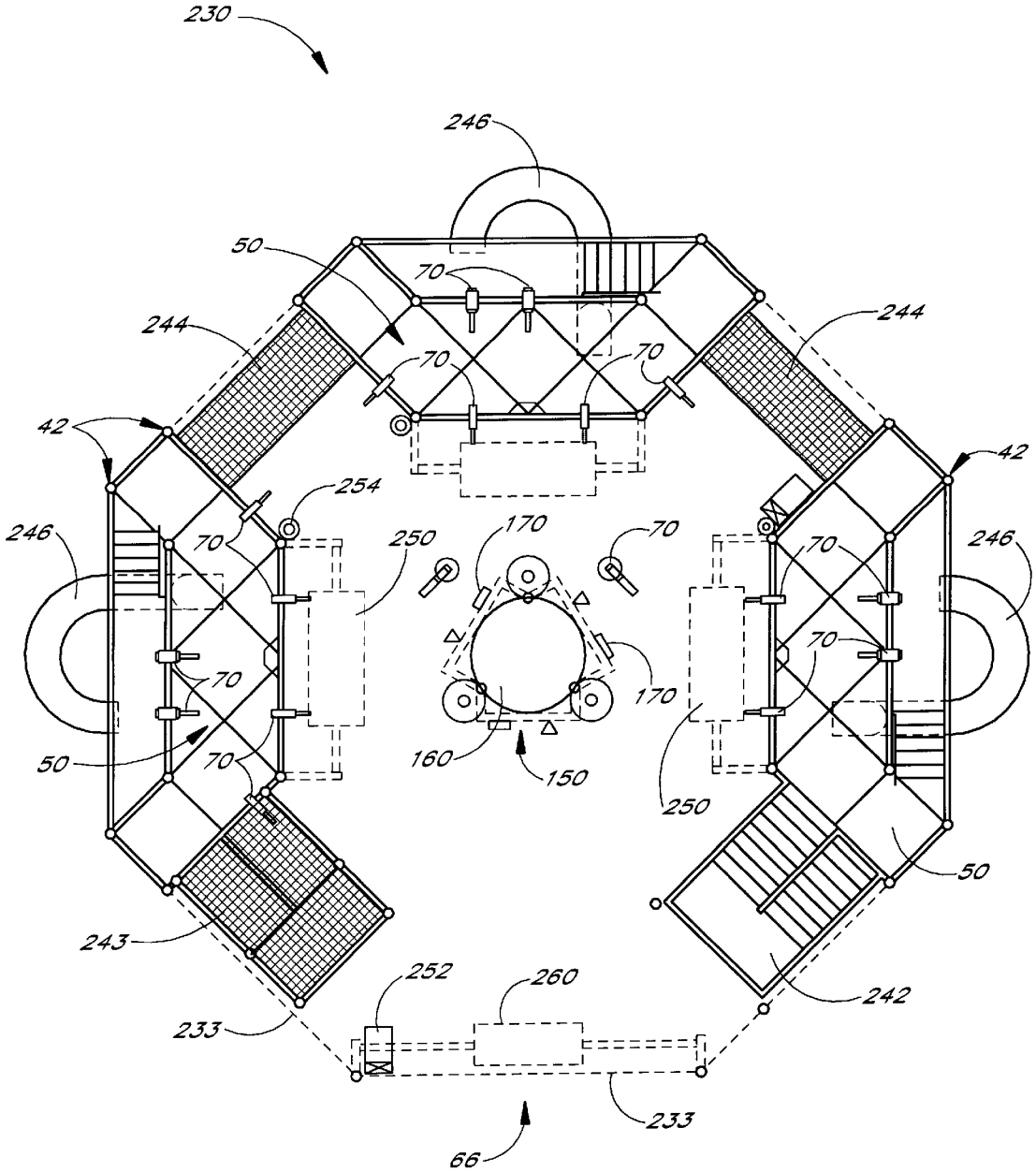
FIG. 13 is a schematic floor plan view of another embodiment of play structure and housing having features of the present invention.

FIGS. 12 and 13 show schematic plan views of other embodiments of play structures 130, 230 having features in accordance with the present invention. These embodiments will be discussed in more detail below; however, certain attributes common to the shown embodiments are discussed together.

Each play apparatus 30, 130, 230 comprises a multi-level structure constructed using any one of a number of materials and construction techniques well known to those skilled in the art. The structure may be suitable for either outdoor or indoor use, as desired, but is preferably disposed outdoors as an independent attraction. Preferably, the structure comprises a supporting framework 42 formed from a plurality of interconnected support members, comprising columns, pylons, beams, connectors and the like. The support members may be formed from any combination of convenient materials having sufficient strength and durability for safely supporting multiple play participants. For example, plastic or PVC pipes, steel pipes, I-beams or channel beams, reinforced concrete beams/columns, and the like may all be used to form the supporting framework 42. Steel pipe supports ranging in diameter from about 2–12 inches and, more preferably, from about 4–6 inches (10–15 cm) are preferred for most applications.

A number of modular platforms are preferably supported between adjacent pylon or column members at various desired elevations with respect to ground level defining various play areas or "towers" 50. These are preferably of an open floor construction, such as steel or fiberglass grating, so as to allow play participants to see down or up through the various levels.

For visual appeal and added safety, optional decorative panels 62 and/or roofing elements 64 may be provided, as desired, to complement the particular desired theme of the particular play arena 40, to shade play participants from the sun or to prevent play participants from falling off the play stations 50. These option panels may be made from wood, fiberglass, reinforced fabric, PVC, or other corrosion-resistant materials, as desired. Those skilled in the art will readily appreciate that a wide variety of other decorative or thematic elements may be incorporated into the overall design in order to provide added safety or convey a particular desired play theme.

Preferably, a number of conduits are provided throughout the framework 42 for transporting play media to and from various play areas in the play structure. The conduits may be formed from plastic or PVC pipes joined together using commercially available fittings, as is well known in the art. Conduits may also be formed from a wide variety of other suitable materials such as steel pipe, ceramic/clay pipe, or they may be formed as open channels and/or runners, as desired. Clear or colored/transparent plastic pipes having an inner diameter of about 2⅛"–6½" (5.4–16.5 cm), and more preferably about 3–4" (7.6–10 cm), are particularly preferred for aesthetic appeal and added excitement Alternatively, larger or smaller diameter conduits or conduits having different colors or shapes may be used, as desired, to accommodate various sizes and shapes of balls or other play media. In the particular embodiments shown, twisted flexible hose conduits are used in various selected locations throughout the play structure to help complement the theme of the play structure and to transport balls or other play media between the various interconnected play areas. Play media may be transported by use of pressurized air or other suitable means, as desired. Various participant-operated conveyors may also be employed to circulate balls or other play media from one area of the structure to another, as will be described in greater detail below.

Preferably, the housing walls 32 establish an exterior perimeter of the play arena 40 and prevent projectiles or other play media from escaping the play attraction 30. Since play participants may be tempted to take dry play media such as foam projectiles with them as they leave the structure, there is a need for a means of monitoring or regulating play participants. A door 66 formed through one of the walls 34 facilitates regulated entry and exit of play participants. Also, the walls 34 and roof 36 protect the play media from environmental elements. The wall cladding or panels 62 and roof 36 are adapted to accept and support themed graphics thereon to customize the play attraction.

Interactive Play Media

The particular preferred embodiments shown in the Figures utilize hundreds or thousands of soft foam balls as an interactive dry play medium. As used herein, the term "dry" is intended only to distinguish from liquid play media, such as water. It should not be construed as requiring the complete absence of liquid or liquid attributes. As used herein, the term "foam" includes any substance or combination of substances having the general resiliency and/or impact absorbing characteristics of an expanded foam material, including, without limitation, expanded polyurethane, expanded EVA foam, foam rubber, soft rubber, styrofoam, air-filled balls or other articles, bean bags or stuffed articles, and the like.

In one preferred embodiment the foam balls may be affected by play participants using various interactive play elements to create desired effects. For example foam balls, such as those commonly known as Nerf™ balls, may be used in accordance with one embodiment of the invention. Other balls may also be used ranging in size from approximately 1" to 12" (2.5 cm to 30.5 cm) in diameter or larger, as desired, or preferable about 2½" (6.3 cm) in diameter. Preferably, the balls are not so small as to present a choking hazard for young children. The majority of the balls may be the same size, or a mixture of ball sizes may be utilized, as desired.

A few play elements, as described below, may utilize balls of a relatively large diameter—about 12" (30 cm) or more. Certain play elements may use only certain sized balls, with filtering relays (not shown) in the conduits permitting only certain sized balls to roll to certain play areas. A range of colors for the balls may also be used for visual appeal. Optionally, ball sizes and/or types may be color-coded as desired to indicate their use with particular play elements or in certain play zones and/or for facilitating their return to the proper areas when they are removed.

Most preferably for optimal performance, durability and safety the play media preferably comprises hundreds or thousands of closed cell foam balls fabricated from an expanded ethylene vinyl acetate (EVA) material having a density of between about 1–5 lbs/ft$^3$ (16–80 kg/m$^3$) and, more preferably, a density of about 2 lbs/ft$^3$ (32 kg/m$^3$). The balls may be spherical in shape, as shown, or they may be provided in a wide variety of other shapes, as desired. Aerodynamic shapes are particularly preferred, although not required. For example, spherical, bullet or dart shaped projectiles may be used to enhance the accuracy and/or distance of the play media when thrown or launched using a projectile launching apparatus. Spherical balls may be dimpled, if desired, to improve their aerodynamic properties.

The size, shape and mass of the ball is preferably sufficient to produce a smooth trajectory without excessive wobbling or spiraling during flight. On the other hand, ball projectiles are preferably impact-safe—that is, the size and mass of the ball projectile is preferably not so great as to produce a risk of injury to play participants upon impact, taking into account the impact velocity and the material composition of the ball projectile. It has been found that a ball diameter of about 2½ inches (6.3 cm) and a weight of about 0.15 oz. (4.25 grams) provides a particularly suitable compromise between these competing objectives. This correlates to a preferred EVA density of about 2 lbs/ft$^3$ (32 kg/m$^3$). Of course, other ball sizes ranging from about 1½–7 inches (4–18 cm) may also be used, depending upon the particular application and the distance, velocity and accuracy requirements. Again, preferably the ball projectiles are not so small as to present a choking hazard for young children or a slipping hazard when the projectiles are scattered about a floor or other supporting surface.

Other suitable play media may include, without limitation, foam, plastic or rubber balls and similarly formed articles such as cubes, plates, discs, tubes, cones, rubber or foam bullets/arrows, the present invention not being limited to any particular preferred play media. These may be used alone or in combination with one another. For instance, flying discs, such as Frisbees™, may be flung from one location on the play structure while other play participants shoot at the discs using foam balls or suction-cup arrows. Durable plastic or rubber play media are most preferable in an outdoor play structure where environmental exposure may prematurely destroy or degrade the quality of certain play media such as foam balls.

Interactive Play Elements

Various interactive play elements 70 are disposed in, on and/or around the play structure to allow play participants to create desired effects, as illustrated. These may include devices such as projectile accelerators, cannons, interactive targets, dry fountains or geysers, cranes, filter relays, and the like for amusing and entertaining play participants or producing desired visual, aural or tactile effects.

Some interactive play elements 70 may have immediate effects, while others may have delayed effects. Some play elements 70 may produce local effects while others may produce remote effects. Each play participant, or sometimes a group of play participants working together, must experiment with the various play elements 70 and associated actuators in order to discover which ones operated in which sequence will create the desired effect(s). Once one group figures it out, they can use the resulting play effect to surprise and entertain other play participants. Yet other play participants will observe the activity and will attempt to also figure it out in order to turn the tables on the next group. Repeated play on a particular play element can increase the participants' skills in accurately producing desired effects or increasing the size or range of such effects. Optionally, play participants can compete with one another using the various play elements to see which participant or group of participants can create bigger, longer, more accurate or more spectacular effects.

Projectile Accelerators

Various projectile accelerators or projectile launchers, such as guns, cross-bows, catapults and cannons, provide particularly exciting interactive play elements in accordance with the present invention. Several preferred embodiments of such interactive accelerators are described below by way of example only. Those skilled in the art will readily appreciate that a wide variety of other accelerator devices are possible and desirable for producing the benefits and advantages in accordance with the present invention. A number of such projectile accelerators are described in my copending U.S. application Ser. No. 08/920,000, which was filed Aug. 28, 1997 and is hereby incorporated by reference.

In accordance with a particularly preferred embodiment of the invention, an accelerator may require the cooperative efforts of multiple play participants at multiple locations and/or levels of the play structure to produce a desired play effect. For example, a play participant at a distant location or elevation may load play media into a basket or other receptacle. This may be connected by a conduit to a loading tube in order to provide ammunition to a flywheel accelerator (not shown). Another play participant cranks a wheel which generates power to run the accelerator. Yet a third play participant aims and fires the accelerator by actuating a suitable trigger device. In this manner, multi-level interactive play is attained. Alternatively, an overhead hopper (not shown) may be used to collect play media for use in the accelerator. The hopper may be fed by various conduits or conveyor systems of the play structure, the hopper having an outlet for supplying play media to the basket and/or other interactive play elements, as desired.

Other types of suitable accelerators or projectile launchers may also be used. For example, in one embodiment a launch tube is provided that is substantially sealed at one end and sized and configured to accommodate insertion of an impact-safe projectile. An air reservoir is provided for containing a charge of compressed air. A nozzle is disposed adjacent the sealed end of the launch tube and is adapted to receive the compressed air from the reservoir and deliver it into the launch tube between the projectile and the sealed end of the launch tube. A valve is interposed between the nozzle and the air reservoir, which can be actuated by a play participant to place the nozzle in communication with the compressed air in the air reservoir. Upon actuation of the valve, the nozzle delivers the charge of compressed air into the launch tube, expelling the projectile from the launch tube and into the air or at a selected target.

In accordance with another embodiment a projectile launcher includes a housing and a launch tube sized and configured to accommodate insertion of an impact-safe projectile. An air reservoir is disposed on or within the housing for containing a charge of compressed air. A play-participant-operated pump is provided to enable play participants to pump a charge of compressed air into the air reservoir. A valve is interposed between the air reservoir and the launch tube and is adapted, when actuated, to place one end of the launch tube in communication with the compressed air contained within the air reservoir. Upon actuation of the valve, the nozzle delivers the charge of compressed air to the launch tube, propelling the projectile down the launch tube and into the air or at a selected target. The launch tube may be formed of a clear acrylic tube and a strobe light may be provided for illuminating the launch tube during launch. A nozzle may be provided within the launch tube for directing the stream of air at the projectile. The nozzle may have a plurality of apertures adapted to create a substantially coherent high-velocity stream of air to propel a projectile down the launch tube by momentum transfer.

In accordance with another embodiment a projectile launcher may include a launch tube sized and configured to accommodate insertion of an impact-safe projectile with substantially little or no friction between the launch tube inner wall and the projectile. A nozzle is disposed adjacent one end of the launch tube. The nozzle is adapted to receive a flow of compressed air from a source and to discharge a stream of high-velocity air so as to impinge upon the projectile disposed within the launch tube. A play-participant-actuated valve is interposed between the nozzle and the source of compressed air to control the flow of air to the nozzle. The valve is adapted, when actuated, to place the nozzle in communication with the source of compressed air. Upon actuation of the valve the nozzle discharges a stream of high-velocity air which transfers momentum to the projectile, propelling it down the launch tube and into the air or at a selected target.

A pressure regulator and/or relief valve (not shown) is also preferably provided in the air source and/or in the supply line or projectile launcher to ensure that safe air pressure levels are maintained during operation of the foam projectile launcher. An air pressure of about 40–60 PSI (276–414 kPa) is adequate for satisfactory operation of a projectile launcher. If multiple foam projectile launchers are provided on a participatory play structure, an optional safety control manifold is preferably provided having a master control valve and pressure regulator and separate control valves and regulators for each air line provided to each projectile launcher or group of projectile launchers and/or other pneumatic devices. Advantageously, this enables individual control and adjustment of air pressure provided to each projectile launcher or group of projectile launchers.

Any of the above-described accelerators may be decorated or "themed" to convey a particular desired play theme or idea. For example, accelerators may be configured to simulate cannons, laser guns, machine guns or the like. Accelerators may be mounted within a plexiglass hemisphere mounted under a floor of an upper level of the play structure so as to simulate a gunners turret of a World War II bomber. As another example, brightly colored foam, plastic, or metal pieces could be attached to the housing of a foam projectile launcher to create a structure resembling a robot, circuit board, factory machinery or other fanciful structure, as desired. The number and variety of play theme possibilities is virtually endless, but all are contemplated to be within the scope of the invention as herein disclosed. Yet other accelerators may be mounted on a moving vehicle, such as a train or steerable vehicle, capable of transporting one or more play participants. Roving vehicles such as an automobiles, busses, tanks or space ships may also provide an exciting complement to a particular desired theme.

Figure 15:
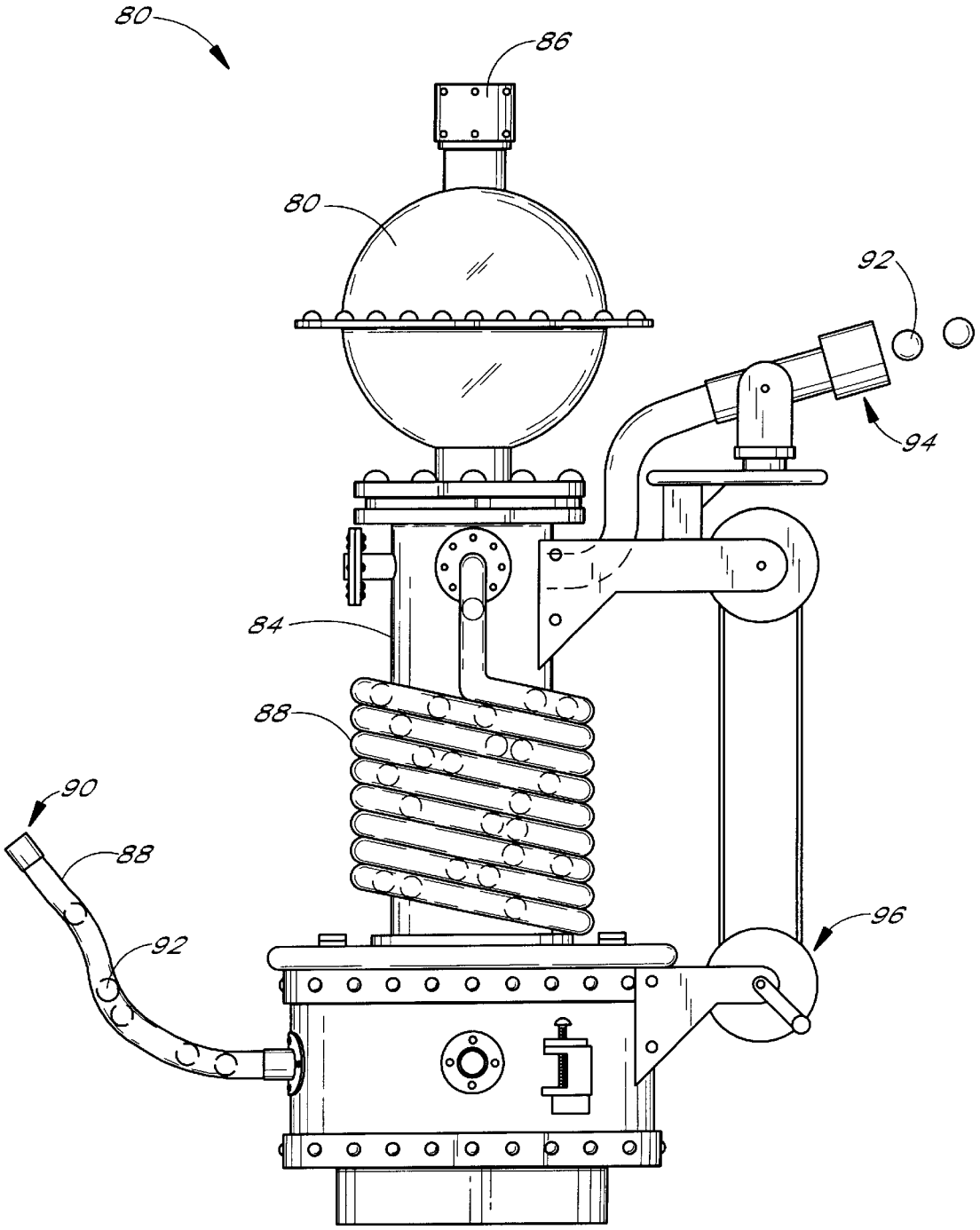
FIG. 15 is a side view of one embodiment of a projectile launching device for use in play structure having features of the present invention.
Figure 17:
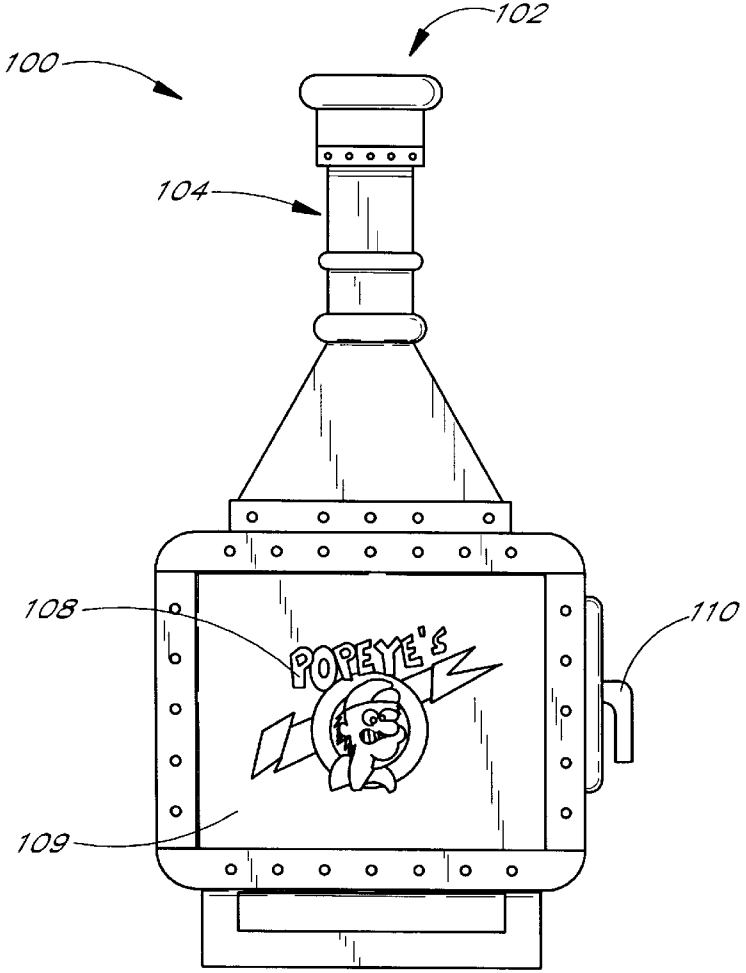
FIG. 17 is a side view of the projectile launching device of FIG. 16.
Figure 16:
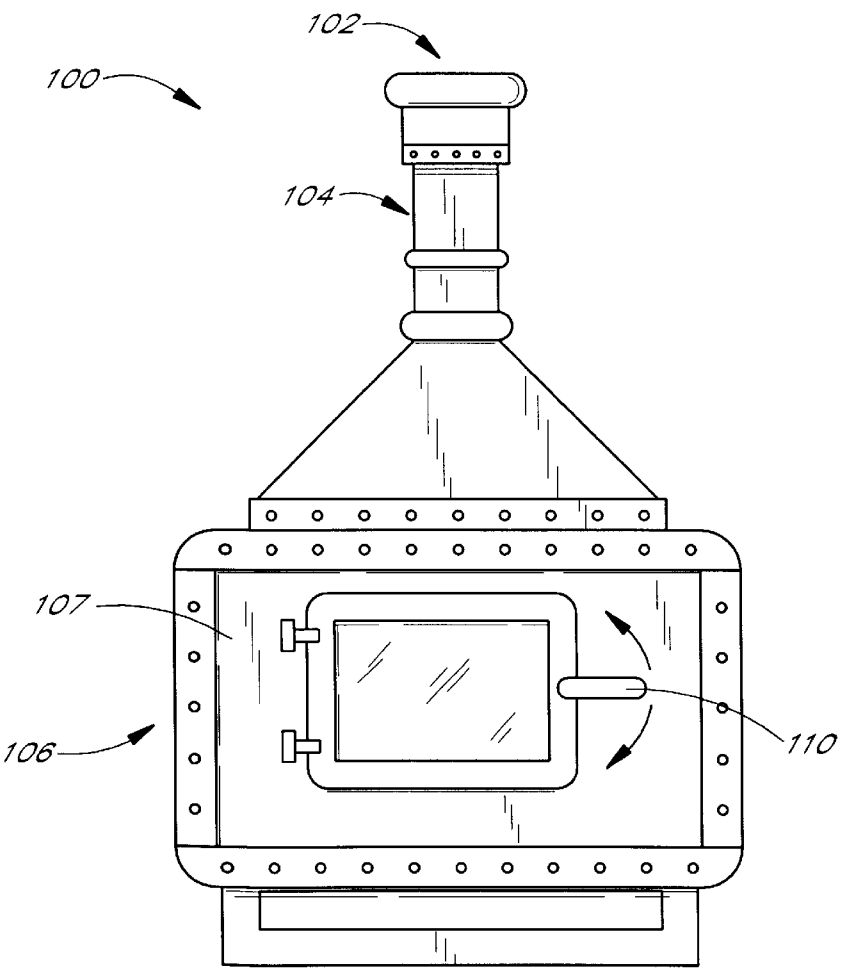
FIG. 16 is a front view of one embodiment of a projectile launching device for use in play structure having features of the present invention.

FIGS. 15–17 present examples of other projectile launchers decorated in accordance with themes. With reference to FIG. 15, an embodiment of an accelerator 80 decorated after the theme of a fog machine comprises a globe 82 which fills with a fog or steam produced within a housing 84 of the accelerator 80 and dispersed through a chimney 86. A hose 88 is wrapped around the housing 84 and is connected to a source of air flow. A feeder end 90 of the hose 88 accepts projectiles 92 inserted therein by play participants and the air flow urges the projectiles 92 through the hose 88 and into the housing 84. The hose 88 is translucent and play participants can watch the projectiles 92 moving therethrough. Eventually, the projectiles 92 are blown from the housing 84 and out of a barrel 94 by a source of air pressure. A pulley system 96 is adapted to allow play participants to aim the barrel 94.

FIGS. 16 and 17 show another embodiment of a themed projectile accelerator 100. The particular projectile launcher 100 is themed as a "spinach oven" and launches projectiles out of a barrel 102 formed in its "chimney" 104. Graphics 106 on a front 107 of the accelerator 100 represent glowing ambers burning inside an oven. A side 109 of the oven has a graphic 108 depicting "Popeye." Actuation of a handle 110 by a play participant triggers the launching of a ball or other projectile out of the chimney 104.

Of course, those skilled in the art will readily appreciate that a wide variety of other projectile accelerators and the like may be, and desirably are, provided throughout the various levels of the play structure in order to allow play participants to interact with one another using the various play media and interactive play elements.

Interactive Target Arena

As noted above, FIG. 12 shows a schematic floor plan of a preferred embodiment of a play structure 130 and housing 132 having features and advantages in accordance with the present invention.

Figure 14:
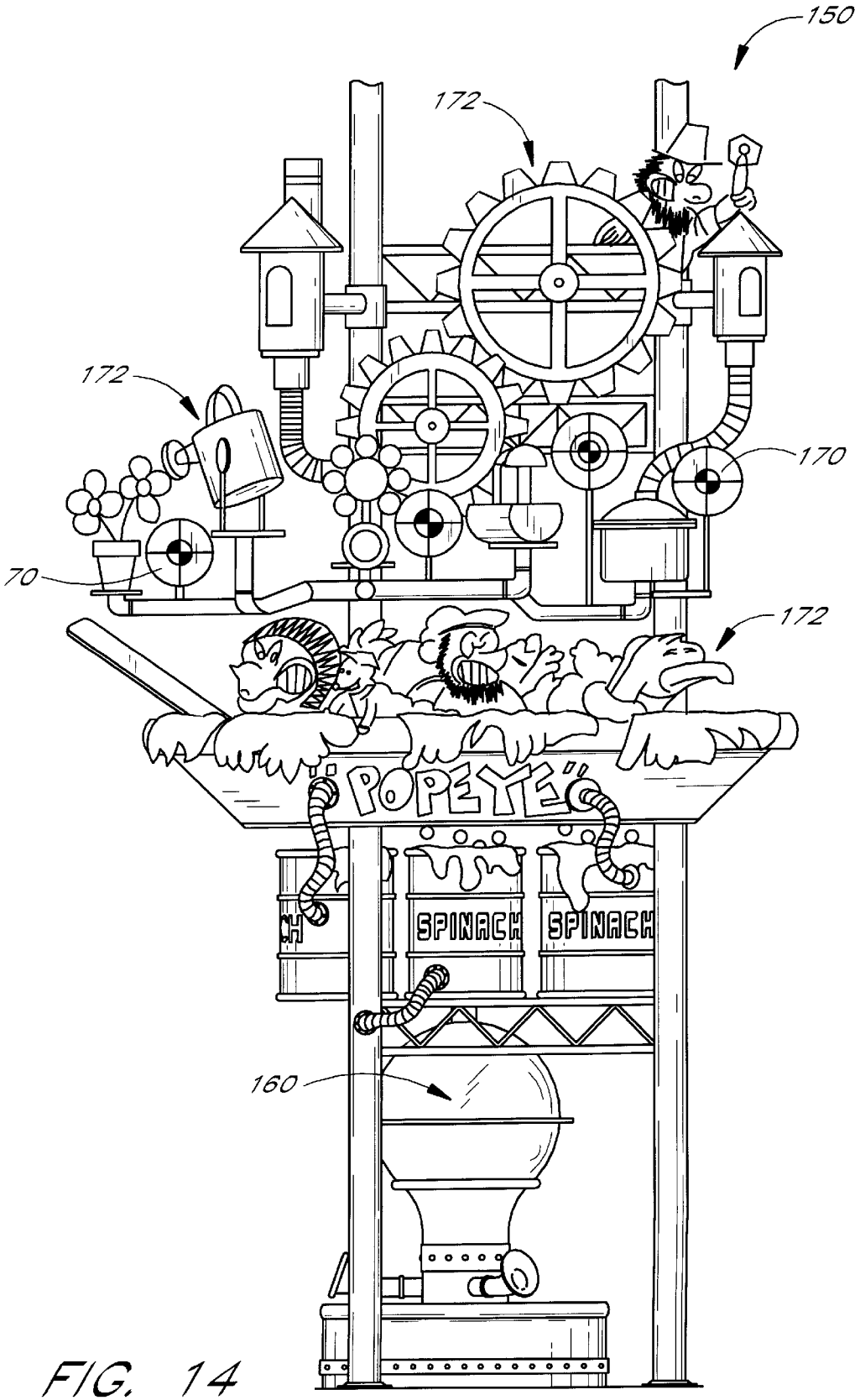
FIG. 14 is a schematic drawing of one embodiment of a central target tower in the theme of "Popeye"

The play structure 130 typically comprises multiple play elements 70 disposed on a plurality of towers 50 positioned around the perimeter of a centralized target tower 150 similar to that shown in FIG. 14. The towers 50 may have multiple levels and/or platforms between which play participants can traverse using stairs 152, ladders, bridges 154 or the like. In addition, the multiple levels may be connected by slide poles, slides 156, climbing nets 158, or other means commonly used by those skilled in the art.

The play stations 50 incorporate a variety of participatory play elements 70 spaced every few feet. The term "play element" 70 will refer to any device that can be manipulated or controlled by one or more play participants to create a desired effect, such as spraying balls, sound effects, ringing bells, sounding buzzers, spinning wheels, turning on and off lights, and the like. Play elements 70 may include, without limitations, such devices as pneumatic ball launchers, sling shots, ball geysers and the like.

Preferably, three tower play stations 50 are disposed around the circumference of the structure 130. The target tower 150 is located above a centralized source of balls or other launchable play media. One embodiment of such a source of media may include a ball geyser 160 located directly under the target tower 150 such that, when activated, the geyser 160 sprays upward within the tower framework simulating an oil geyser, for example.

Each play station 50 is linked to the centralized ball source 160 through a series of runnels. The runnels transfer balls from the source to the outlying towers 50. Those skilled in the art will appreciate that the runnels may be replaced by pipes, tipping trays, any of a number of conveyor types, a play participant bucket brigade, or a variety of other well-known conveying devices.

After balls are transferred to the towers 50, they may later be carried upward to baskets 154 disposed above the play stations 50. This second transfer may be achieved through a variety of methods known to those skilled in the art. In the preferred embodiment, a play participant operates a conveyer (not shown) in order to complete the transfer to the upper basin 154. As may be appreciated, any number of methods and devices known to those skilled in the art may be used to complete this transfer. If desired, the transfer and recirculation of balls may be continuous or they may be broken into separate timed or untimed competitions.

The various ball launchers are used in this preferred embodiment to direct balls or other impact-safe projectiles at other play participants or, alternatively, at the centralized target tower 150. With reference to FIG. 14, the target tower 150 contains one or more actuating targets 170 for actuating multiple order effects. The targets 170 are interspersed among various themed graphics 172 such as characters, gears or flowers. When a target 170 is contacted by a ball, the target 170 causes a second effect to be activated for a preselected time duration. For example, the play participants may replenish their "ammunition" supply by contacting a specified target 170 which in turn releases a stream of balls directed along a runnel to the play participants' location. In one embodiment, striking the target 170 will activate a device such that a stream of balls is directed into a self-tipping bucket 180 located above the play station of a second set of play participants; thus, the multiple order effect creates a three way competition to dump balls on the opponents. The self-tipping bucket 180 may be conditionally stable and, upon filling to a predetermined level, will spill its contents onto the play station 50 and play participants below it.

In still another embodiment, striking a target 170 may have varied effects to reward precise shooting by the play participants. Multiple solenoids may be connected to a single effect such that opening each successively will increase the intensity of the effect when activated. Hitting any of the targets 170 successively within a certain time period may activate a third valve such that an even greater effect is achieved.

In addition to an assortment of interactive targets 170, the target tower 150 may also contain a number of bells, buzzers, lights, indicators, sound effects, and other similar items. For example, a target 170 may capture a ball and redirect it toward another tower. Various targets 170 may or may not be linked to solenoids to create further effects. The nature of the effects, duration and number of elements involved may vary depending upon the difficulty of actuating the various associated targets. For example, targets that are very difficult to hit may produce more dramatic effects so as to encourage play participants to actuate those effects by hitting the appropriate targets in the appropriate order. Various sound effects, flashing lights and other related effects may add to the excitement or assist play participants by informing them which targets need to be hit in which order to produce the desired effects. In this manner, play participants cooperate to activate the targets in the desired order to create the desired play effect. As a reward for activating a major play effect, play media may be released from a central chamber to yet other play devices to increase the level of excitement in the play structure. Alternatively, interactive play elements may change from manual loading to automatic or semi-automatic operation as a reward for actuating certain targets. This, in turn, may assist play participants to activate even further targets to achieve the next level of reward.

Additional interactive play elements 70 may be disposed at various locations around the structure 130. For instance, a dump bucket 182 may be suspended overhead near the door 66 and receive projectiles supplied by a runnel system 184 that catches balls from the ball geyser 160 and channels them into the dump bucket 182. Play participants may also help fill the bucket 182 by delivering balls along a pulley system (not shown). Contact with a target 170 or multitude of targets triggers the dump bucket 182 to open, pouring its contents on play participants below.

Yet additional interactive play elements 70 that may be disposed at various locations about the structure 130 include catapults, conveyors, megaphones, talk tubes, noisemakers, a telescope or periscope, flags and sling shots.

To accommodate such interactive play media and target play, the play structure 130 and housing preferably have a specialized shape. Conventional rectangular buildings generally have corner areas that are secluded and non-interactive with the rest of the facility. For an interactive apparatus, such comers would constitute wasted space out of touch with the rest of the play structure. Accordingly, there is a need for a play arena that facilitates interaction between play participants scattered about the entire arena. A preferred shape avoids isolated comers so that the entire structure is accessible to play participants and nearly every participant in the structure can be seen and targeted by other participants. To accomplish this goal, the play structure housing 132 is preferably many-sided, having between 5 and 10 sides. Most preferably, the play structure has eight sides 133, each side 133 substantially facing the central target arena 150 after the manner of a "regular octagon." Furthermore, the play structure 130 should be adapted to encourage interactive play between towers 50 within the apparatus. Therefore, the distance between opposing sides 133 of the structure is preferably between about 40 and 80 feet and is most preferably between about 50 to 60 feet. Although it is not necessary that the sides 133 of the structure 130 be the same length, they are preferably in the range of 20 to 40 feet and are most preferably between 25 and 30 feet in length.

FIG. 13 shows a plan view of another embodiment of an interactive dry play structure 230 having features in accordance with the present invention. The structure 230 has eight sides 233, one of which has a door 66 for entry and exit of play participants. Three play towers 50 are disposed along the periphery of the structure 230. Participants access the towers 50 by climbing stairs 242, ladders, or rope netting 243. Rope web bridges 244 extend between the towers 50, providing a path for play participants to travel from one tower 50 to the next.

Each of the towers 50 has at least one platform for supporting play participants thereon. A slide 246 conducts participants from a platform of each tower 50 to the floor below. A plurality of play elements 70 such as projectile accelerators are disposed on each tower 50. A drum-shaped dumping basket 250 is disposed above each tower 50. Balls are loaded into the drums 250 by a conveyor or by vacuum hoses 254 fed by play participants. Each drum 250 fills with balls until a trigger signal is received, at which time the drum 250 tips and the load of balls is dumped on play participants below. Similarly, an overhead dumping basket 260 is disposed near the door 66. A vertical conveyor 262 transports balls from the floor to the dumping basket 260. When a trigger signal is received, the basket 260 opens and balls are dumped on those below.

A central target area is disposed in the middle of the structure 230 and has a central target tower 150 located therein. Targets 170 disposed in the central target section and on the central tower 150 trigger effects such as the dumping basket 260 or the drums 250. A ball geyser 160 within the arena shoots balls into the air. The geyser 160 may be triggered by a play participant or group of play participants working together to actuate a number of targets 170 in a desired order, or may be programmed to intermittently blow balls upward, scattering them throughout the structure 230 and feeding a conveyor system which distributes balls to various play elements.

Interactive Conveyors

To supply the various interactive play elements and other effects with a play media, various devices are preferably provided to collect and transport play media in and around the play structure. These may include, for example, passive collection and/or transportation devices, such as collection basins, channels and/or troughs, or they may include active or interactive collection and transportation devices. Various conveyor systems are disclosed and described herein by way of illustration only. Those skilled in the art will readily appreciate that a wide variety of other collection and/or transportation devices may be used while still enjoying the advantages and benefits of the present invention as taught herein.

Various conveyor systems may be linked with one another or with other passive, active, semi-active or interactive conveyor systems so as to extend over several locations or levels of the play structure. Thus, for example, an archimedes screw conveyer may form but one part of a more complex interactive play effect that is comprised of a sequence of smaller effects, each operated by a number of different play participants cooperating together to create an overall desired effect. Passive collection devices and conveyors may also be used to collect and transport play media to the various areas of the play structure as needed. These devices include items such as collection basins, troughs, conveyor belts, pneumatic conduits, continuous belt elevators and the like. For example, drains and traps may be provided at various locations in and around the play structure and housing to help collect spent play media. Collection lines may be provided above or below the ground level to route play media to other collection areas such as a sump. Play media may also be collected by a gently sloping perimeter gutter. A vacuum may also be used to suck up play media and deliver it to a central accumulator. Various gates and valves may be provided throughout the play structure to allow play participants to control the flow of play media to the various areas of the play structure and to various effects.

Cleaning and/or decontamination devices may also be provided for continuously or periodically cleaning play media circulated throughout the play structure. These may be passive or interactive, as desired. For example, a chlorine bath may be provided in combination with a brush or ultrasonic cleaner in order to remove dirt and contaminants from spent play media, as needed. Play participants may turn a crank or other input device to operate an interactive cleaner and watch as balls or other play media slosh about the cleaner housing, which is preferably formed of a clear material. Drying of play media may also be provided in a similar manner, as desired.

Passive or automated conveyers for collecting and recirculating play media are also possible. These are particularly desirable for large play structures or multi-level play structures since the balls will have a tendency to accumulate in the lower levels. Thus, it may be desirable to have an automated or passive conveyer or recirculation system which collects and transports the play media to upper levels or to particular interactive devices as desired. Those skilled in the art will readily appreciate that a wide variety of automated collection and/or conveyor systems may be used while enjoying the advantages and benefits of the present invention as taught herein.

Although this invention has been disclosed in the context of certain preferred embodiments, it will be understood by those skilled in the art that the present invention extends beyond the specifically disclosed embodiments to other alternative embodiments of the invention. Thus, it is intended that the scope of the present invention herein disclosed should not be limited by the particular disclosed embodiments described above, but should be determined only by reference to the claims that follow.

What is claimed is:

1. A free-standing self-contained play apparatus comprising:

a housing having a plurality of walls and a roof structure;

a plurality of play towers disposed within the housing and adapted to safely support one or more play participants, said towers arranged around a central target area having a plurality of targets, the targets adapted to create one or more desired effects when contacted; and a plurality of projectile accelerators disposed in, on or around the apparatus.

2. A play apparatus as in claim 1, wherein the housing has from 5–10 walls.

3. A play apparatus as in claim 1, wherein the housing has eight walls.

4. A play apparatus as in claim 3, wherein the housing is in the shape of a regular octagon.

5. A play apparatus as in claim 1, wherein the towers are arranged so that a play participant on any tower can be targeted by a second play participant on another tower.

6. A play apparatus as in claim 5, wherein at least one of the towers has multiple levels.

7. A play apparatus as in claim 5, wherein the towers are connected by at least one bridge extending between the towers.

8. A play apparatus as in claim 1, further including a door through the housing for play participant entry and exit.

9. A play apparatus as in claim 1, further including at least one conveyor adapted to transport impact-safe play media.

10. A play apparatus as in claim 1, further including a central target tower located within the central target area and having at least one target disposed thereon.

11. The play apparatus of claim 10, wherein the target is adapted to trigger an associated play effect for a predetermined duration of time when the target is contacted by play media directed at the target by a first projectile accelerator.

12. A play apparatus as in claim 1, further including play element means for entertaining play participants.

13. The play apparatus of claim 1, in combination with an impact-safe foam ball having a diameter of about 2½ inches, and a weight of about 0.15 oz. and being formed from an expanded ethylene vinyl acetate material having a density of about 2 lbs/ft$^3$.

14. The play apparatus of claim 1, wherein the housing is formed or decorated in accordance with a predetermined play theme or play object.

15. The play apparatus of claim 14, wherein the housing is formed in the shape or theme of a medieval castle.

16. The play apparatus of claim 14, wherein the housing is formed in the shape or theme of a lost temple.

17. The play apparatus of claim 14, wherein the housing is formed in the shape or theme of a military fort.

18. The play apparatus of claim 14, wherein the housing is formed in the shape or theme of a fire station.

19. The play apparatus of claim 14, wherein the housing is formed in accordance with a theme of a children's story.

20. The play apparatus of claim 1, wherein at least one of the towers includes multiple levels, each level being adapted to safely support one or more play participants.

21. The play apparatus of claim 20, wherein at least one of the projectile accelerators is positioned on each level.

22. The play apparatus of claim 1, comprising a play effect adapted to be actuated in response to actuation of two or more associated targets, each of the associated targets adapted to be actuated by a projectile impacting or entering various target areas of the associated targets.

23. The play apparatus of claim 22, wherein the play effect is adapted to be enhanced when the associated targets are actuated according to a predetermined sequence.

24. The play apparatus of claim 1, additionally comprising a series of runnels adapted to communicate play media from a source of the play media to at least two projectile accelerators.

25. The play apparatus of claim 1, wherein one of the projectile accelerators comprises a barrel for directing play media in a desired direction, the barrel connected to and adapted to be aimed by a pulley system, and the pulley system is adapted to be controllable by play participants.

26. The play apparatus of claim 25, additionally comprising a slide adapted to transport play participants from a first level to a second level.

27. The play apparatus of claim 26, wherein the play effect releases a stream of play media to the location of the first projectile accelerator.

28. The play apparatus of claim 26, wherein a conditionally stable bucket is disposed above a second projectile accelerator, and the play effect releases a predetermined amount of play media into the conditionally stable bucket, and wherein the conditionally stable bucket is adapted to spill at least a portion of its contents when it is filled beyond a predetermined level.

29. The play apparatus of claim 28, wherein a second conditionally stable bucket is disposed above the first projectile accelerator, the second conditionally stable bucket being adapted to spill at least a portion of its contents when filled beyond a predetermined level, and a second target is adapted to trigger a second play effect when the second target is contacted by play media, and the second play effect releases a predetermined amount of play media into the second conditionally stable bucket.

30. The play apparatus of claim 26, wherein the first projectile accelerator has a default operating condition, and the play effect temporarily changes the operating condition to an enhanced operating condition.

31. The play apparatus of claim 30, wherein the default operating condition comprises manual loading of the projectile accelerator.

32. The play apparatus of claim 31, wherein the enhanced operating condition comprises automatic loading and firing of the projectile accelerator.

33. The play apparatus of claim 31, wherein the enhanced operating condition comprises automatic loading and semi-automatic firing of the projectile accelerator.

34. A method for providing a themed self contained interactive play attraction for entertaining play participants, comprising the steps of:

providing a free-standing housing comprising a plurality of sides and a roof;

providing a plurality of towers disposed within the housing, said towers adapted to safely support one or more play participants;

providing a plurality of impact-safe projectile launchers disposed at various positions and elevations on the towers; and providing a plurality of targets.

35. The method of claim 34, further including the step of providing a central target area, the central target area having a plurality of targets so as to facilitate competitive target shooting among play participants on the various towers to create one or more desired effects.

36. A free-standing self-contained play apparatus comprising:

a housing having a plurality of walls and a roof structure;

a plurality of play towers disposed within the housing and adapted to safely support one or more play participants;

a first-order interactive play element supported by one of said plurality of play towers and adapted to receive play media comprising discrete play articles from a source to create a first effect; and a second-order interactive play element supported by one of said plurality of play towers and adapted to receive play media from the first effect to create a second effect, whereby play participants can observe and experiment with various multiple-order cause-and-effect reactions utilizing any one of a number of fun and exciting play media.

37. The play apparatus of claim 36, wherein the plurality of walls defines an outer perimeter of the housing, and the walls are adapted to prevent play media from escaping the housing.

38. The play apparatus of claim 37, wherein the second-order play element comprises a projectile accelerator adapted to discharge play media and the first-order interactive play element comprises a play participant-operated conveyer adapted to transport play media from a source to the projectile accelerator.

39. The play apparatus of claim 38, wherein the conveyer comprises a tube.

40. The play apparatus of claim 39, wherein at least a portion of the conveyer tube is substantially transparent.

41. The play apparatus of claim 37, wherein the first-order play element comprises a projectile accelerator adapted to discharge play media and the second-order play element comprises a target adapted to actuate a play effect when contacted by play media.

42. A free-standing enclosed play arena, comprising:

a supporting framework comprising a plurality of interconnected columns, beams and pylons;

a roof structure supported by the supporting framework;

a plurality of walls secured to the supporting framework and adapted to define a perimeter of the play arena;

a plurality of platforms supported between adjacent pylons or columns at various desired elevations relative to a ground level, the platforms being adapted to safely support one or more play participants;

play media comprising discrete play articles;

a plurality of projectile accelerators mounted in, on, or around the supporting framework; and a conveyor system adapted to transport play media from the ground level to at least one of the projectile accelerators.

43. The play arena of claim 42, wherein the platforms are arranged around a central target area having a plurality of targets, and the targets are adapted to actuate one or more desired effects when contacted.

44. The play arena of claim 43, in combination with an impact-safe foam ball having a diameter of about 2½ inches, and a weight of about 0.15 oz. and being formed from an expanded ethylene vinyl acetate material having a density of about 2 lbs/ft$^3$, and at least one of the projectile accelerators is adapted to accelerate the impact-safe foam ball.

45. The play arena of claim 44, wherein the platforms are arranged so that a play participant on any platform can be viewed by a second play participant on another platform.

46. The play arena of claim 45, wherein the projectile accelerators are adapted so that the projectile accelerators can project the impact-safe ball from one platform to another platform.

47. The play arena of claim 43, additionally comprising a central target tower located within the central target area and having at least one target disposed thereon.

48. The play arena of claim 47, wherein the desired effects comprise play element means for entertaining play participants.

49. A self-contained play arena comprising:

a free-standing housing comprising a plurality of sides and a roof;

a plurality of play towers disposed within the housing, each of the play towers comprising at least one platform adapted to safely support one or more play participants;

a plurality of projectile launchers disposed at various positions and elevations on the play towers, the projectile launchers adapted to propel discrete impact-safe play media in a desired direction;

a central target tower having a plurality of targets, the targets adapted to trigger one or more play effects when contacted; and the play towers are arranged around the central target tower.

50. The play arena of claim 49, wherein the sides of the housing define a perimeter of the play arena and are adapted to prevent play media from escaping the play arena.

51. The play arena of claim 50, wherein the housing is in the shape of a regular octagon.

52. The play arena of claim 49, additionally comprising conveyor means for transporting play media from a source of play media to the projectile launchers.

53. The play arena of claim 52, wherein the conveyor means is adapted to be operated by play participants.

54. The play arena of claim 49, additionally comprising a cleaning apparatus for cleaning the play media.

* * * * *